United States Patent [19]

Katsuki et al.

[11] 4,186,179

[45] Jan. 29, 1980

[54] PROCESS FOR PRODUCING OXIDIZED OR CARBON FIBERS

[75] Inventors: Kosuke Katsuki; Shizuo Watanabe, both of Ehime, Japan

[73] Assignee: Toray Industries, Inc., Tokyo, Japan

[21] Appl. No.: 12,119

[22] Filed: Feb. 14, 1979

Related U.S. Application Data

[63] Continuation of Ser. No. 910,871, May 30, 1978, abandoned.

[30] Foreign Application Priority Data

May 30, 1977 [JP] Japan ..... 52-62091

[51] Int. Cl.[2] ..... D01F 9/14; D01F 9/22

[52] U.S. Cl. ..... 423/447.4; 8/115.5; 264/29.2; 423/447.2; 423/447.6

[58] Field of Search ..... 423/447.1, 447.2, 447.4, 423/447.6, 447.8; 264/29.2; 8/115.5

[56] References Cited

U.S. PATENT DOCUMENTS

| | | | |
|---|---|---|---|
| 3,533,743 | 10/1970 | Prescott et al. | 423/447.6 |
| 3,552,923 | 1/1971 | Carpenter et al. | 423/447.6 |
| 3,567,380 | 3/1971 | Townsend | 423/447.6 |
| 3,914,960 | 10/1975 | McGuffin et al. | 423/447.6 X |
| 4,065,549 | 12/1977 | Kinoshita et al. | 423/447.4 |

FOREIGN PATENT DOCUMENTS

| | | | |
|---|---|---|---|
| 2606290 | 8/1976 | Fed. Rep. of Germany | 423/447.4 |
| 1130304 | 10/1968 | United Kingdom | 423/447.4 |

*Primary Examiner*—Edward J. Meros

*Attorney, Agent, or Firm*—Finnegan, Henderson, Farabow & Garrett

[57] ABSTRACT

Disclosed is an improvement in a process for producing oxidized fibers wherein precursor fibers comprised of oxidizable continuous filaments are repeatedly brought into or out of contact with the surface of a heated body, maintained at a temperature of from approximately 200° to 400° C., in an oxidizing gaseous atmosphere thereby to be oxidized. The oxidized fibers can then be heated in a non-oxidizing gaseous atmosphere maintained at a temperature of at least approximately 800° C. to produce carbon fibers, if desired. The improvement resides in that an interlaced filament yarn is used as the precursor fibers, which yarn substantially has no crimps or loops and is comprised of continuous filaments entangled with each other along the longitudinal direction thereof to an extent such that the coherency factor of the yarn is in the range of from approximately 20 to 100.

10 Claims, 4 Drawing Figures

PROCESS FOR PRODUCING OXIDIZED OR CARBON FIBERS

RELATED APPLICATION

This application is a continuation of U.S. application Ser. No. 910,871, filed May 30, 1978, now abandoned.

FIELD OF INVENTION

This invention relates to a process for producing an oxidized or carbon fiber.

DESCRIPTION OF THE PRIOR ART

Since carbon fibers possess many advantageous properties such as high mechanical strength and modulus of elasticity, high corrosion resistance, high thermal resistance and low density, they are widely used as composites in many different applications such as aerospace structural components, rocket motor casings, deep submergence vehicles and ablative materials for heat sheilds on re-entry space vehicles.

Such carbon fibers are produced generally by subjecting an oxidizable precursor fiber such as an acrylic fiber, cellulose fiber (rayon), polyvinyl alcohol fiber or pitch fiber to oxidation treatment in an oxidizing gaseous atmosphere maintained at a temperature of approximately 200° to 400° C. and, thereafter, subjecting the oxidized fiber to carbonization or graphitization treatment in a non-oxidizing gaseous atmosphere maintained at a temperature of at least approximately 800° C.

In order to enhance the mechanical strength and modulus of elasticity of the carbon fiber produced by the conventional process, it has been proposed, as disclosed in U.S. Pat. No. 3,412,062, to conduct the oxidation treatment of a precursor fiber in an oxidizing gaseous atmosphere of a temperature which is as high as possible and for a period of time sufficient for substantially completely oxidizing the fiber throughout the entire cross-section thereof. This proposed process is, however, not advantageous because it reduces fiber productivity and enhances production costs. Furthermore, in the above-mentioned proposed process, an oven is required in order to maintain the oxidizing gaseous atmosphere at a predetermined temperature necessary for oxidizing the fiber. The use of such an oven involves the following problems. First, it is difficult to precisely control the temperature of the oxidizing gaseous atmosphere. Secondly, when a precursor fiber is continuously treated in such an oven, thermally decomposed products, such as tar, formed inside the oven are deposited and accumulated on the inner wall of the oven and on accessories such as fiber guides provided inside the oven. The thermally decomposed products often adhere to the precursor fiber passing through the oven, thus causing a reduction in the quality of the resulting carbon fiber. Thus, it is necessary to stop the continuous operation of oxidizing the fiber in order to clean the oven at regular intervals.

In order to overcome the defects of the above-mentioned process involving the use of an oxidizing oven, it has recently been proposed in Japanese Patent Laid-open Application Ser. Nos. 46,593/1976 and 64,022/1976 that a precursor fiber be oxidized not by heating it in a gaseous atmosphere of a high temperature but by repeatedly bringing the precursor fiber into and out of contact with the surface of a heated body such as a hot roller and a hot plate, maintained at a temperature of approximately 200° to 400° C. This proposed process is advantageous in that the period of time required for oxidizing the precursor fiber to the desired extent can be shortened, in that the heat energy similarly required can be decreased, and in that problems caused by the thermally decomposed products may be eliminated from the proposed process. However, this proposed process is still not completely satisfactory because it involves the following problem. That is, when precursor fibers are brought into contact with the surface of a heated body at an enhanced fiber density and at an increased travelling speed in order to enhance the productivity of carbon fibers, the fibers are liable to become fluffy during the oxidation step and, sometimes, the fibers may break.

SUMMARY OF THE INVENTION

An object of the present invention is to provide an improvement in a process for producing oxidized fibers, and more preferably carbon fibers, wherein precursor fibers are oxidized by repeatedly bringing the fibers into and out of contact with the surface of a heated body maintained at a temperature of approximately 200° to 400° C. Then, if desired, the oxidized fibers are subjected to carbonization or graphitization in a non-oxidizing gaseous atmosphere maintained at a temperature of at least approximately 800° C. to produce carbon fibers. By the improvement, precursor fibers can be brought into contact with the surface of a heated body at an enhanced fiber density and at an increased travelling speed, without any disadvantageous occurrences of fiber fluffing or fiber breakage. Thus, oxidized fibers and carbon fibers of good quality and performance can be produced with an enhanced degree of productivity.

Other objects and advantages of the present invention will be apparent from the following description.

In accordance with the present invention, there is provided an improvement in a process for producing oxidized fibers wherein precursor fibers comprised of oxidizable continuous filaments are repeatedly brought into or out of contact with the surface of a heated body, maintained at a temperature in the range of from approximately 200° to 400° C. to be thereby oxidized. This improvement is characterized by using, as the precursor fibers, an interlaced yarn which substantially has no crimps or loops and which is comprised of continuous filaments entangled with each other along the longitudinal direction thereof to such an extent that the coherency factor of the yarn is in the range of from approximately 20 to 100. The oxidized fibers can then be heated in a non-oxidizing gaseous atmosphere maintained at a temperature of at least approximately 800° C. so as to become carbonized or graphitized if it is desirable to produce carbon fibers.

BRIEF DESCRIPTION OF THE DRAWINGS

The accompanying drawings show examples of apparatuses used in the process of the invention, wherein.

DETAILED DESCRIPTION OF THE INVENTION

Figure 1:
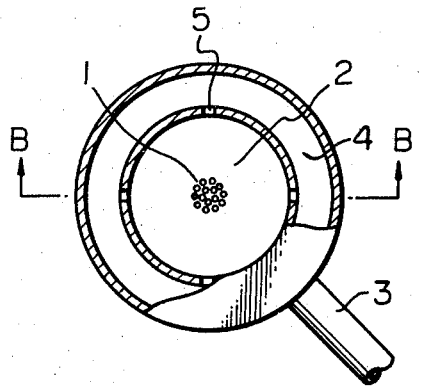
FIG. 1 is a plan view partly showing the cross-section of one example of the apparatuses used for making an interlaced filament yarn.

The precursor fibers used in the process of the invention are in the form of an interlaced yarn comprised of oxidizable or carbonizable continuous filaments. The continuous filaments are not specifically limited to the particular types; therefore, any type of conventional oxidizable or carbonizable continuous filaments may be used. Suitable continuous filaments include, for example, those which are made of an acrylonitrile polymer, cellulose (rayon), polyvinyl alcohol, pitch and lignin. Preferable filaments are those which are made of copolymers comprised of, based on the weight of the copolymer, at least 85% by weight of acrylonitrile and not more than 15% by weight of one or more copolymerizable monoethylenically unsaturated monomers which are capable of accelerating the oxidation of the precursor fibers. Such copolymerizable monomers include, for example, itaconic acid, acrylic acid, methacrylic acid, alkali and ammonium salts of these acids, and 2-(hydroxyethyl)acrylonitrile and 2-(hydroxybutyl) acrylonitrile.

The continuous filaments of the interlaced yarn should be entangled with each other along the logitudinal direction thereof to such an extent that the coherency factor of the yarn is in the range of from approximately 20 to 100, preferably from 30 to 80.

By the term "coherency factor" used herein is meant a measure representing the extent of entanglement of filaments, which factor is determined as follows. A specimen having a length of 100 cm is cut from a bundle of continuous multifilaments. One end of the specimen is fixed to the upper end of a ruler showing centimeter graduations. A weight is hung on the hook attached to the other end of the specimen, which weight has a gram number corresponding to about one fifth of the total denier number of the specimen. However, when the total denier of the specimen exceeds 500 deniers, the weight is maintained constant at 100 g. One end portion of a hook, having two curved end portions is inserted into the filament bundle specimen at a position approximately 0.5 to 1.0 centimeter below the fixed point of the specimen. A weight having a gram number corresponding to 2.5 times the denier number of a single filament of the specimen is hung on the hook to cause the hook to slip down by a certain distance along the specimen. The distance from the point at which the hook is inserted into the specimen to the point at which the weighted hook stops slipping down is measured; this distance is referred to as "L". The measurement of the distance L is repeatedly conducted on 100 specimens. Of the 100 so-obtained numerical values for L, the upper 20 values and the lower 20 values are omitted, and an average value for the distance L is calculated based on the remaining 60 values. The coherency factor of the yarn is then calculated by using the following equation:

Coherency factor (CF) = 100/average distance L If the filament yarn is not extangled at all, the coherency factor thereof is 1.0. The greater the coherency factor is, the greater the extent of entanglement of the filaments of the yarn.

When the coherency factor of the yarn is lower than approximately 20, the yarn will cause the following problems. That is, when the yarn is brought into contact with the surface of a heated body during the oxidation step, the width of the yarn will tend to increase, and as a result, filaments in both side end portions of the yarn will be caused to come into contact with filaments of the adjacent yarns, thus causing undesirable fluff formation in the yarns and, occasionally, filament breakages. However, if the distance between two adjacent yarns brought into contact with the heated surface is increased in order to prevent or mitigate the above-mentioned problem, i.e., the yarn density or the total denier of filaments on the heated surface is lowered (the term "yarn density" used herein means the weight of filaments brought into contact with the heated surface, for example, of a heated roller, per unit length in the axial direction of the heated roller, and is usually expressed in deniers per centimeter.), the productivity of oxidized or carbon fibers is inevitably reduced.

In contrast, a yarn having an extremely high coherency factor, i.e., exceeding approximately 100, is difficult to prepare without any substantial damage occurring to the filaments.

The interlaced filament yarn used in the process of invention may be prepared as follows. A bundle of filaments is subjected to a fluid jet treatment. That is, a multifilament yarn is passed through a turbulence zone formed by a stream or streams of compressible fluid such as air ejected from a confined space, whereby filaments are entangled with each other to a certain extent. Such a fluid jet treatment process is well known as a bulking process for making a textured yarn for apparel use from a multifilament yarn, and is disclosed, for example, in Japanese Patent Publications Nos. 12,230/1961 and 1,1975/1962.

Figure 2:
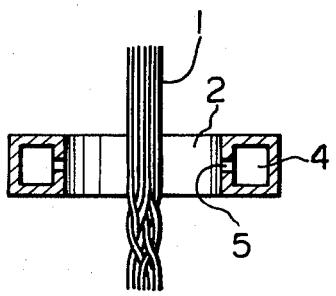
FIG. 2 is a cross-sectional view cut along the line B—B′ shown in FIG. 1.

One example of the interlacing apparatuses used for the fluid jet treatment is shown in FIGS. 1 and 2, which are a plan view partly showing the cross-section and a cross-sectional view cut along the line B—B' in FIG. 1, respectively. The interlacing apparatus comprises a compressed fluid feeding tube 3 and a doughnut-shaped fluid distributor having a plurality of fluid ejecting orifices 5. A compressed fluid such as air, supplied from the feeding tube 3 to a distributing space 4 within the distributor, is ejected through the orifices 5 to the center of the doughnut-shaped distributor, thus forming a turbulence zone 2 in the center of the distributor and the vicinity thereof. A bundle of filaments 1 is passed through the turbulence zone 2 where the filaments are entangled with each other to a certain extent, and withdrawn therefrom as an interlaced yarn.

The interlaced yarn should not possess any substantial crimps or loops for providing oxidized or carbon fibers having desirably uniform mechanical properties. For this purpose a tension sufficient for preventing the filaments from slackening should be applied to the filaments passing through the turbulence zone. The tension applied to be applied thereto should preferably be in the range of from 0.05 to 0.2 g/d.

The total denier of and the number of filaments in the bundle to be interlaced may be varied depending upon the capacities of the oxidation and carbonization apparatuses. Preferably, the total denier should be in the range of from 1,000 to 100,000 deniers, and the number of filaments should be in the range of from 500 to 200,000. When the total denier and the number of filaments are outside the above-mentioned ranges, it becomes difficult to make an interlaced filament yarn which does not have any crimps or loops but which has a desired coherency factor. Furthermore, the operational stability of the yarn in the interlacing step and the productivity of the yarn are inevitably reduced.

The interlaced filament yarn so made is oxidized by repeatedly bringing the yarn into and out of contact with the surface of a heated body such as a hot roller or a hot plate. The surface temperature of the heated body should be maintained in the range of from approximately 200° to 400° C., preferably from approximately 260° to 380° C. The contact time ($T_1$) per contact of the filament yarn with the surface of the heated body should be not more than one second. When the contact time $T_1$ exceeds one second, the filament yarn tends to be fused and broken during the oxidation step, and thus, it is difficult to obtain carbon filaments which are pliable and easily separable into single filaments and which have no fluffs.

The heated body is placed in an oxidizing gaseous atmosphere, such as molecular oxygen, oxidized nitrogen, air and other oxygen-containing gases, for oxidizing filaments during the repeated contacts thereof with the surface of the heated body. Preheating the oxidizing gas is not necessary or should even be avoided because filaments are liable to be oxidized at an uncontrollable increasing rate and liable to be burned occasionally. However, such difficulty is not encountered at the temperature reached by the oxidizing gas in the present invention due to the fact that the oxidizing gas atmosphere is not directly heated but that heated bodies are continuously used in the oxidizing gas atmosphere.

The number of times in which the filament comes into contact with the heated surface should usually be such that the resulting oxidized filament exhibits a moisture content of approximately 3.5 to 15%, preferably approximately 6 to 10%, although the optimum number of times may be varied depending upon the shape and size of the heated body used and the surface temperature thereof. When the moisture content is less than approximately 3.5%, it becomes difficult to carbonize the oxidized filaments to the desired degree and the carbon filaments are poor in mechanical properties. In contrast, when the moisture content exceeds 15%, the carbonization yield is lowered and the carbon filaments also become poor in mechanical properties due to the oxidative degradation of the filaments.

By the term "moisture content" used herein is meant the value determined as follows. Approximately 2 g of oxidized filaments are left to stand for 16 hours in a desiccator. The temperature and humidity of the desiccator are controlled at 25° C. and 81%, respectively, with an aqueous saturated ammonium sulfate solution in which a solid phase also co-exists. The filaments are then taken out therefrom, weighed and reported as (W). After drying the filaments in a dryer maintained at 120° C. for two hours, the filaments are again weighed and reported as ($W_0$). The moisture content is calculated from the following equation:

$$\text{Moisture content in } \% = [(W - W_0)/W_0] \times 100$$

The heated body used during the oxidation step of the invention is preferably comprised of at least one pair of heated rollers, particularly Nelson rollers, around which the filaments are wound. The Nelson rollers are advantageous in that the contact time of the filaments with the heated surface can be easily and precisely controlled by adjusting the rotation speed of the rollers, and further in that the filaments can travel without any frictional contact with the heated surfaces, thereby causing no fluff formation in the filaments.

Figure 3:
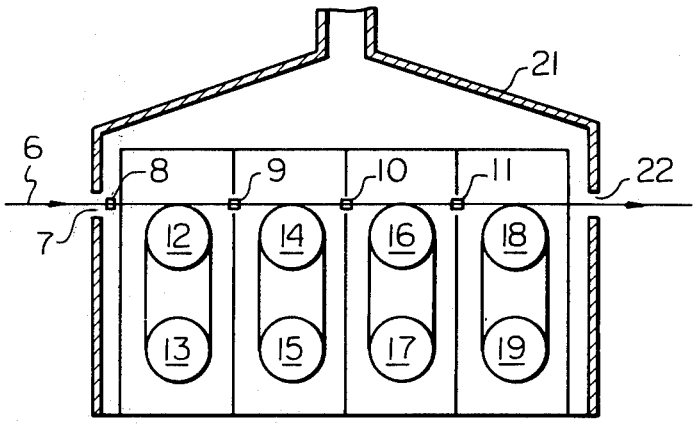
FIG. 3 is a vertical cross-sectional view of one example of the apparatuses used in the oxidation step of the invention.
Figure 4:
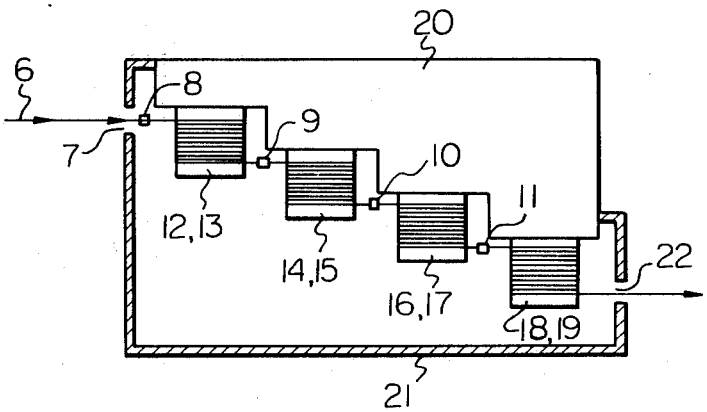
FIG. 4 is a horizontal cross-sectional view of the apparatus shown in FIG. 3.

One preferred arrangement of the heated rollers is shown in FIGS. 3 and 4, in which an oxidized filament yarn 6 travels through an inlet 7 into a cover box 21 where the yarn 6 is wound sequentially around four pairs of rollers 12-13, 14-15, 16-17 and 18-19. The yarn windings may be Nelson-like or zigzag. Reference numerals 8, 9, 10 and 11 designate yarn passage guides. A frame 20 on which the rollers are mounted is provided, although not shown, with heating means for maintaining the respective roller surfaces at predetermined temperatures and driving means for revolving the respective pairs of rollers at predetermined speeds. These rollers are heated so that their surfaces are maintained at temperatures in the range of from approximately 200° to 400° C. The surface temperatures may be either the same as or different from each other. It is preferable, however, that the surface temperature increases in accordance with the consecutive order of the rollers 12-13, 14-15, 16-17 and 18-19. The cover box 21 serves to mitigate heat loss from the respective roller surfaces and to prevent thermal decomposition gases, generated during the oxidation of filaments, from leaking into the atmosphere. An oxidizing gas, introduced into the cover box 21, is maintained at a temperature lower than those of the roller surfaces, preferably in the range of from room temperature to approximately 200° C. When the oxidizing is maintained at a higher temperature, the filaments tend to be fused together, broken and sometimes burnt due to the uncontrollable exothermic reaction. The number of yarn windings may be varied depending upon the total denier and the travelling speed of the yarn. The rotation speed of the rollers should be such that the contact time of the yarn with the roller surface is not longer than approximately one second per contact.

The oxidized filaments may be carbonized in a conventional manner in a non-oxidizing atmosphere such as nitrogen, helium or argon, and maintained at a temperature of at least 800° C., preferably of from 1,000° to 1,600° C. If desired, the obtained carbon filaments may be graphitized in a conventional manner in a non-oxidizing atmosphere which is similar to that mentioned above and which is maintained at a temperature higher than the carbonization temperature, usually of at least 2,000° C.

The advantages of the present invention may be summarized First, troubles such as fluff formation and yarn breakage occurring during the oxidation step (which troubles sometimes occur in the oxidation processes disclosed in Japanese Patent Laid-open Application Ser. Nos. 46,593/1976 and 64,022/1976) can be prevented or mitigated. Thus, the quality of the resulting oxidized or, if carbonized, carbon fibers is high. Secondly, both the yarn density on the surface of a heated body and the yarn travelling speed can be increased, and hence, productivity of oxidized or carbon fibers can be increased. Thirdly, an interlaced filament yarn used in the present invention can be prepared without the use of a twisting machine. In other words, it is possible to adjust the filament travelling speed occurring during the interlacing step so as to be similar to the speeds occurring during the filament preparation step and the oxidation step, which adjustment enables the adoption of a continuous process spanning from the precursor filament preparation step to the precursor filament oxidation step.

The present invention will be further illustrated by the following examples.

EXAMPLE 1

A bundle of 3,000 filaments of approximately 1.2 denier per filament, prepared in a conventional manner from a copolymer comprised of 99% by mole of acrylonitrile and 1% by mole of 2-(hydroxybutyl)acrylonitrile, was air jet-treated by using an interlacing nozzle of the type shown in FIGS. 1 and 2 to thereby obtain an interlaced yarn. The interlaced yarn had a coherency factor of 40 but did not exhibit any crimps or loops. The interlaced yarn was continuously oxidized in the air by using an apparatus of the type shown in FIGS. 3 and 4. The apparatus used was provided with four pairs of rollers 12-13, 14-15, 16-17 and 18-19, each roller having a diameter of 200 mm and an axial length of 1,000 mm. Each roller had a heater built therein. The peripheral surfaces of the respective four pairs of rollers were maintained at temperatures of 285°, 290°, 300° and 330° C., respectively. The interlaced yarn was wound 92 times around each pair of rollers, i.e., 368 windings in total. The yarn density was 5,000 deniers/cm. The travelling speed of the yarn was 30 m/min. The contact time of the yarn per each contact with the roller surface was 0.63 second, and thus, the total contact time was 7.7 minutes. The oxidized yarn had a moisture content of 6.7% at 87% relative humidity. The oxidized yarn exhibited neither fusion between filaments nor fluffing, and had good pliability.

The oxidized yarn was continuously carbonized in a nitrogen atmosphere maintained at a temperature of 1,300° C. by using a tubular carbonization oven which was 1,000 mm in length. The travelling speed of the yarn was 1 m/min. The so-obtained carbon filaments had the following properties.

Tensile strength—313 kg/mm$^2$
Young's modulus—21.6 ton/mm$^2$
Elongation—1.45%
Specific gravity—1.75
No. of fluffs—5/m

EXAMPLE 2

In accordance with a procedure similar to that mentioned in Example 1, the acrylonitrile copolymer filaments were air jet-treated under various interlacing conditions thereby to obtain a plurality of filament yarns of different coherency factors. These filament yarns were oxidized and then carbonized in manners similar to those mentioned in Example 1.

For comparison purposes, acrylonitrile copolymer filaments similar to those mentioned above but not air jet-treated, and acrylonitrile copolymer filaments similar to those mentioned above but twist-treated by using a conventional twister, instead of being air jet-treated, were oxidized and then carbonized in ways similar to those mentioned in Example 1.

The condition of the respective filaments observed during the oxidation step, the number of fluffs formed in the respective filaments during the oxidation step, and the mechanical properties of the carbon filaments are shown in Table I, below.

Table I

| Specimen No.*1 | Filaments | | Condition of filaments | No. of fluffs (per meter) | Carbon filaments Tensile strength (kg/mm$^2$) | Carbon filaments Young's modulus (ton/mm$^2$) |
|---|---|---|---|---|---|---|
| 1 | Interlaced C.F.*2 | 20 | Good | 9 | 295–306 | 20.8–21.2 |
| 2 | " | 30 | Good | 5 | 300–311 | 21.2–21.6 |
| 3 | " | 40 | Good | 4 | 309–318 | 20.9–21.3 |
| 4 | " | 60 | Good | 6 | 301–315 | 21.3–22.0 |
| 5 | " | 80 | Good | 5 | 306–321 | 21.6–22.0 |
| 6 | " | 100 | Good | 11 | 295–309 | 21.4–21.9 |
| 7 | " | 120 | Good | 38 | 285–302 | 20.8–21.4 |
| 8 | Not interlaced | 9 | Good | 101 | 280–310 | 20.5–21.1 |
| 9 | Twisted N.T.*3 | 5 | Poor | 4 | 210–290 | 20.1–22.3 |
| 10 | " | 10 | Poor | 6 | 180–270 | 19.5–21.2 |
| 11 | " | 50 | Poor | 3 | 195–265 | 18.9–22.1 |

Notes:
*1Specimens Nos. 1 through 6 are examples of the invention and Specimens Nos. 7 through 11 are comparative examples.
*2Coherency factor
*3No. of twists expressed in turns per meter It was found that all of the twisted yarns exhibited poor conditions during the oxidation step, as shown in Table I, and the yarn density of these twisted yarns on the surfaces of the respective rollers was not uniform. Such nonuniformity of the yarn density caused the temperature distribution on the surfaces of the rollers to also be nonuniform, leading to unevenness in the properties of the oxidized filaments and the carbon filaments.

It was further found that the filament yarn of Specimen No. 8, which was neither interlaced nor twisted and which had an extremely low coherency factor, exhibited a satisfactory condition during the oxidation step, but the number of fluffs formed in the oxidation step was approximately 20 times greater than that of the filament yarn having a coherency factor of from 20 to 80.

The filament yarn, not twisted but interlaced and having an extremely high coherency factor of 120 (No. 7), also exhibited a large number of fluffs formed during the oxidation step, which number was approximately 8 times greater than that of the filament yarn having a coherency factor of from 30 to 80. A plurality of interlaced filament yarns having a coherency factor of approximately 150 were prepared under different interlacing conditions by varying the pressure of the compressed air, the tension applied to the filaments and the type of air-jet nozzle used. These interlaced filament yarns were also found to have a large number of fluffs which were formed during the oxidation step but which were not caused by the interlacing conditions employed. It was confirmed that these interlaced filament yarns had some degree of fluffs before being subjected to oxidation, and that such initial fluffs led to the formation of a large number of fluffs during the oxidation step.

EXAMPLE 3

In accordance with a procedure similar to that mentioned in Example 1, the interlaced filament yarn was oxidized and then carbonized wherein the travelling speed of the yarn in the oxidation step was varied as shown in Table II, below, while all other conditions were maintained substantially the same. Results are shown in Table II, below.

Table II

| Specimen No. | Travelling speed (m/min) | Contact time $T_1$ (sec) | Condition of filaments | No. of fluffs (per meter) | Carbon filaments Tensile strength (kg/mm$^2$) | Carbon filaments Young's modulus (ton/mm$^2$) |
|---|---|---|---|---|---|---|
| 1 | 30 | 0.94 | Good | 3 | 295 | 20.2 |
| 2 | 100 | 0.28 | Good | 5 | 303 | 21.2 |
| 3 | 200 | 0.14 | Good | 4 | 315 | 20.9 |
| 4 | 300 | 0.09 | Good | 4 | 309 | 21.3 |
| 5 | 500 | 0.06 | Good | 4 | 316 | 20.5 |

EXAMPLE 4

In accordance with procedures similar to those mentioned in Example 1, an interlaced filament yarn having a coherency factor of 30 was prepared from a similar acrylonitrile copolymer, and the interlaced filament yarn was oxidized and then carbonized wherein the yarn density on the surface of the roller was varied during the oxidation step as shown in Table III, below, while all other conditions were maintained substantially the same.

Table III

| Specimen No. | Yarn density (deniers/cm) | Condition of filaments | No. of fluffs (per meter) |
|---|---|---|---|
| 1 | 5,000 | Good | 4 |
| 2 | 10,000 | Good | 5 |
| 3 | 20,000 | Good | 5 |
| 4 | 40,000 | Good | 6 |
| 5 | 50,000 | Good | 5 |
| 6 | 60,000 | Good | 26 |

EXAMPLE 5

A bundle of 6,000 filaments, which were spun in the conventional manner from a solution of an acrylonitrile copolymer similar to that used in Example 1, was continuously washed with water, stretched, dried, air jet-treated and then wound around three pairs of heated oxidizing rollers, at a travelling speed of 120 m/min. The apparatus used for the air jet-treatment was similar to that shown in FIGS. 1 and 2. The filaments, air jet-treated but not yet wound around the oxidizing rollers, exhibited neither crimps nor loops, and had a coherency factor of 40. The surface temperatures of the three pairs of rollers were 285°, 290° and 305° C., respectively. The contact time of the filaments per contact was 0.24 second, and thus the total contact time was 9.6 minutes. During the oxidation step, little or no fluff formation was observed, and the condition of the filaments was found to be satisfactory. After oxidation, the oxidized filaments were carbonized in a manner similar to that mentioned in Example 1. The so-obtained carbon filaments exhibited the following properties.

Tensile strength—321 kg/mm$^2$

Young's modulus—22.4 ton/mm$^2$

Failure strain—1.43%

What we claim is:

1. In a process for producing oxidized fibers wherein precursor fibers comprised of oxidizable continuous filaments are repeatedly brought into or out of contact with the surface of a heated body, maintained at a temperature in the range of from approximately 200° to 400° C., in an oxidizing gaseous atmosphere to be thereby oxidized, the improvement comprising using, as the precursor fibers, an interlaced filament yarn substantially having no crimps or loops and comprised of continuous filaments entangled with each other along the longitudinal direction thereof to an extent such that the coherency factor of the yarn is in the range of from approximately 20 to 100.

2. An improvement in a process for producing carbon fibers wherein precursor fibers comprised of carbonizable continuous filaments are repeatedly brought into or out of contact with the surface of a heated body, maintained at a temperature in the range of from approximately 200° to 400° C., in an oxidizing gaseous atmosphere to be thereby oxidized, and then, the oxidized fibers are heated in a nonoxidizing gaseous atmosphere maintained at a temperature of at least approximately 800° C.;

said improvement comprising using, as the precursor fibers, an interlaced filament yarn substantially having no crimps or loops and comprised of continuous filaments entangled with each other along the logitudinal direction thereof to an extent such that the coherency factor of the yarn is in the range of from approximately 20 to 100.

3. A process according to claim 1 or 2 wherein the interlaced yarn is comprised of 1,000 to 100,000 multifilaments, each filament being approximately 0.5 to 3 deniers.

4. A process according to claim 1 or 2 wherein the coherency factor of the yarn is in the range of from 30 to 80.

5. A process according to claim 1 or 2 wherein the filaments are made of a copolymer comprised of at least 85% by weight of acrylonitrile and not more than 15% by weight of at least one copolymerizable monoethylenically unsaturated monomer.

6. A process according to claim 1 or 2 wherein said contact of the filaments with the surface of the heated body is carried out such that the filament density on the surface of the heated body is in the range of from 5,000 to 50,000 deniers per one centimeter of the length of the heated body in the direction perpendicular to the yarn travelling direction, and the contact time of the filaments with the surface of the heated body is in the range of from 0.001 to 1.0 second per contact.

7. A process according to claim 6 wherein the filament density is in the range of from 10,000 to 30,000 deniers per centimeter and the contact time is in the range of from 0.002 to 0.7 second per contact.

8. A process according to claim 1 or 2 wherein said repeated contact with the surface of the heated body is effected until the moisture content in the filaments reaches a value in the range of from approximately 3.5% to 15% by weight based on the weight of the dried filaments.

9. A process according to claim 8 wherein the filaments travel continuously from a precursor fiber preparation step to the precursor fiber oxidation step.

10. In a process for producing carbon fibers wherein precursor fibers comprised of carbonizable continuous filaments are repeatedly brought into or out of contact with the surface of a heated body, maintained at a temperature in the range of from approximately 200° to 400° C., in an oxidizing gaseous atmosphere to be thereby oxidized, and then, the oxidized fibers are carbonized, the improvement comprising using, as the precursor fibers, an interlaced filament yarn substantially having no crimps or loops and comprised of continuous filaments entangled with each other along the longitudinal direction thereof to an extent such that the coherency factor of the yarn is in the range of from approximately 20 to 100.

* * * * *